US008842845B2

(12) United States Patent
Christoph

(10) Patent No.: US 8,842,845 B2
(45) Date of Patent: Sep. 23, 2014

(54) ADAPTIVE BASS MANAGEMENT

(75) Inventor: Markus Christoph, Straubing (DE)

(73) Assignee: Harman Becker Automotive Systems GmbH, Karlsbad (DE)

( * ) Notice: Subject to any disclaimer, the term of this patent is extended or adjusted under 35 U.S.C. 154(b) by 566 days.

(21) Appl. No.: 12/396,145

(22) Filed: Mar. 2, 2009

(65) Prior Publication Data

US 2009/0220098 A1 Sep. 3, 2009

(51) Int. Cl.

| | |
|---|---|
| ***H04R 29/00*** | (2006.01) |
| ***H04R 3/04*** | (2006.01) |
| ***H04R 5/02*** | (2006.01) |
| ***H04S 7/00*** | (2006.01) |

(52) U.S. Cl.

CPC ..... *H04R 3/04* (2013.01); *H04R 2499/13* (2013.01); *H04S 7/302* (2013.01)

USPC ..... 381/59; 381/98; 381/103; 381/300; 381/303

(58) Field of Classification Search

CPC ..... H04R 3/04; H04R 5/02; H04R 29/00

USPC ..... 381/59, 86, 103

See application file for complete search history.

(56) References Cited

U.S. PATENT DOCUMENTS

| | | | | |
|---|---|---|---|---|
| 2001/0016047 | A1 | 8/2001 | Ohta | |
| 2005/0031143 | A1 | 2/2005 | Devantier et al. | |
| 2005/0152562 | A1 | 7/2005 | Holmi et al. | |
| 2007/0025559 | A1 * | 2/2007 | Mihelich et al. | 381/59 |
| 2008/0049948 | A1 * | 2/2008 | Christoph et al. | 381/86 |
| 2008/0273725 | A1 * | 11/2008 | Hartung et al. | 381/302 |

FOREIGN PATENT DOCUMENTS

| | | |
|---|---|---|
| EP | 1843635 | 10/2007 |
| WO | WO 2007016527 | 2/2007 |

* cited by examiner

*Primary Examiner* — Minh-Loan T Tran
*Assistant Examiner* — Fazli Erdem
(74) *Attorney, Agent, or Firm* — O'Shea Getz P.C.

(57) ABSTRACT

The invention relates to a method for adapting sound pressure levels in at least one listening location, the sound pressure being generated by a first and a second loudspeaker, each loudspeaker having a supply channel arranged upstream thereto, where at least the supply channel of the second loudspeaker modifies the phase of an audio signal transmitted therethrough according to a phase function. The method includes supplying an audio signal to the supply channels and thus generating an acoustic sound signal; measuring the acoustic sound signal at each listening location and providing corresponding electrical signals representing the measured acoustic sound signal; estimating updated transfer characteristics for each pair of loudspeaker and listening location; calculating an optimum offset phase function based on a mathematical model using the estimated transfer characteristics; updating the phase function by superposing the optimal offset phase function thereto.

14 Claims, 10 Drawing Sheets

ADAPTIVE BASS MANAGEMENT

1. Claim of Priority

This patent application claims priority to European Patent Application serial number 08 003 731.0 filed on Feb. 28, 2008.

2. Field of the Invention

The present invention relates to equalizing the sound pressure level in the low frequency (bass) range generated by a sound system.

3. Related Art

It is usual practice to manually acoustically optimize dedicated audio systems, for example in motor vehicles. Although there have been major efforts to automate this manual process, these methods and systems, have shown weaknesses in practice or are extremely complex and costly. In small, highly reflective areas, such as the interior of a vehicle, poor improvements in the acoustics are achieved. In some cases, the results are even worse.

Especially in the frequency range below approximately 100 Hertz standing waves in the interior of small highly reflective rooms can cause strongly different sound pressure levels (SPL) in different listening locations that are, for example, the two front passenger's seats and the two rear passenger's seats in a motor vehicle. These different sound pressure levels entail the audio perception of a person being dependent on his/her listening location. However, it has been proven by the work of professional acousticians that it is possible to achieve good acoustic results even with relatively simple audio systems.

A method is known which allows acoustics to be modeled in virtually any area. However, this so-called wave-field synthesis requires extensive resources such as computational power, memories, loudspeakers, amplifier channels, etc. This technique is thus not suitable for many applications for cost and feasibility reasons, especially in the automotive industry.

There is a need for an automatic bass management that is adequate to replace the previously used, complex process of manual equalizing by experienced acousticians and that reliably provides frequency responses in the bass frequency range at predetermined listening locations which match the profile of predetermined target functions. Furthermore, it is desirable that a bass management system be capable to successively adapt the frequency responses in response to variations of the acoustic properties of the listening room during operation.

SUMMARY OF THE INVENTION

A method for adapting sound pressure levels in at least one listening location, includes generating sound pressure by a first and a second loudspeaker, each loudspeaker having a supply channel arranged upstream thereto, where at least the supply channel of the second loudspeaker modifies the phase of an audio signal transmitted therethrough according to a phase function. The method also includes supplying an audio signal to the supply channels and thus generating an acoustic sound signal; measuring the acoustic sound signal at each listening location and providing corresponding electrical signals representing the measured acoustic sound signal; estimating updated transfer characteristics for each pair of loudspeaker and listening location; calculating a phase offset phase function based on a mathematical model using the estimated transfer characteristics; and updating the phase function by superposing the optimal offset phase function thereto.

DESCRIPTION OF THE DRAWINGS

The invention can be better understood with reference to the following drawings and description. The components in the figures are not necessarily to scale, instead emphasis being placed upon illustrating the principles of the invention. Moreover, in the figures, like reference numerals designate corresponding parts. In the drawings.

DETAILED DESCRIPTION

Figure 1:
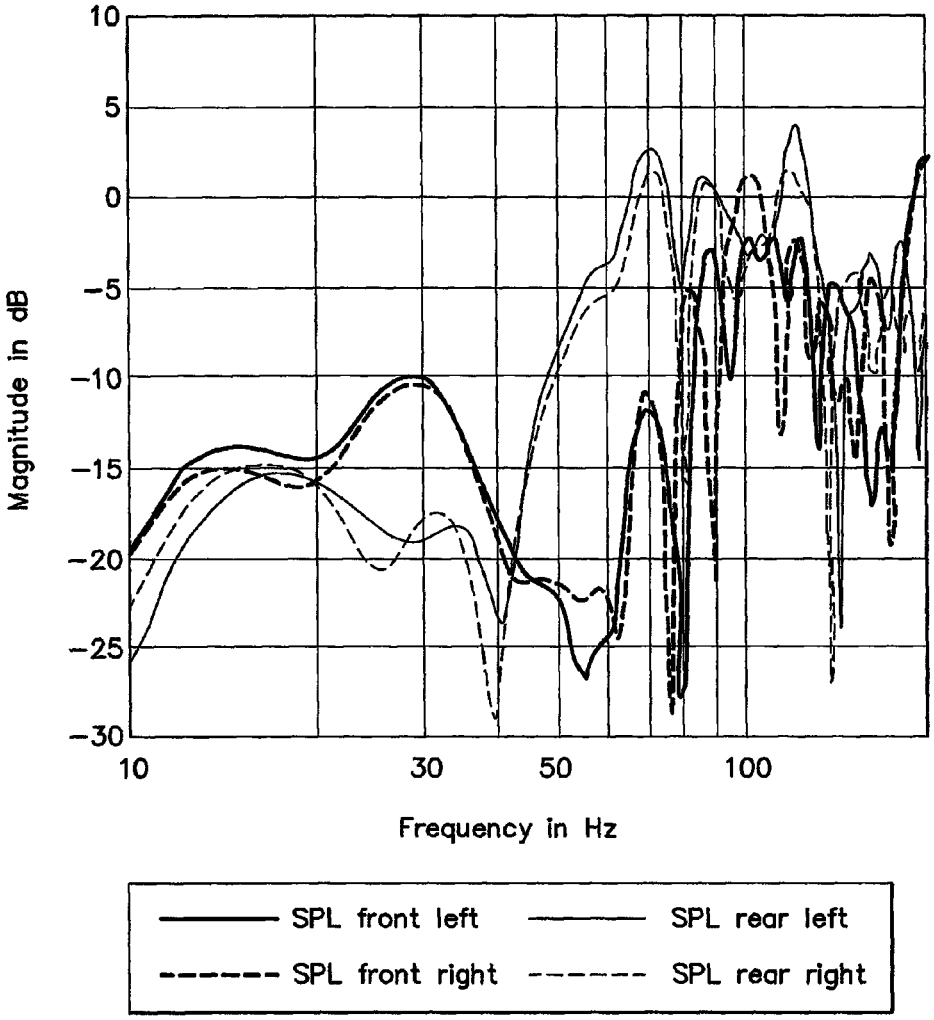
FIG. 1 illustrates the sound pressure level in decibel over frequency measured on four different listening locations within a passenger compartment of a car with an unmodified audio signal being supplied to the loudspeakers.

While reproducing an audio signal using a loudspeaker or a set of loudspeakers in a car, measurements in the passenger compartment of the car yield considerably different results for the sound pressure level (SPL) observed at different listening locations even if the loudspeakers are symmetrically arranged within the car. The diagram of FIG. 1 illustrates this effect. In the diagram four curves are depicted, each illustrating the sound pressure level in decibel (dB) over frequency which have been measured at four different listening locations in the passenger compartment, namely near the head restraints of the two front and the two rear passenger seats, while supplying an audio signal to the loudspeakers. One can see that the sound pressure level measured at listening locations in the front of the room and the sound pressure level measured at listening locations in the rear differ by up to 15 dB dependent on the considered frequency. However, the biggest gap between the SPL curves can be typically observed within a frequency range from approximately 40 to 90 Hertz which is part of the bass frequency range.

"Bass frequency range" is not a well-defined term but widely used in acoustics for low frequencies in the range from, for example, 0 to 80 Hertz, 0 to 120 Hertz or even 0 to 150 Hertz. Especially when using car sound systems with a subwoofer placed in the rear window shelf or in the rear trunk, an unfavorable distribution of sound pressure level within the listening room can be observed. The SPL maximum between 60 and 70 Hertz (cf. FIG. 1) may likely be regarded as booming and unpleasant by rear passengers.

Figure 2:
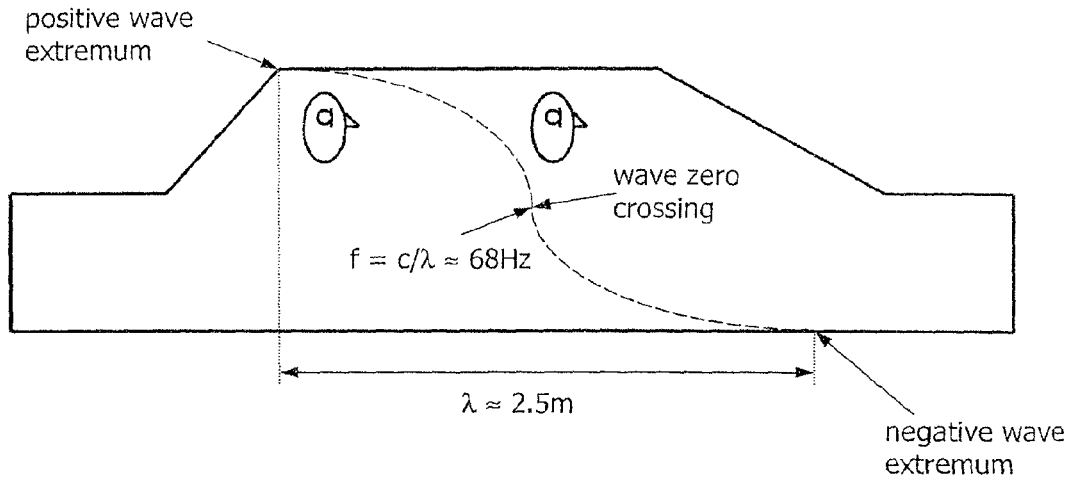
FIG. 2 illustrates standing acoustic waves within the passenger compartment of a car which are responsible for large differences in sound pressure level (SPL) between the listening locations.

The frequency range where a big discrepancy between the sound pressure levels in different listening locations, especially between locations in the front and in the rear of the car, can be observed depends on the dimensions of the listening room. The reason for this will be explained with reference to FIG. 2 which is a schematic side-view of a car. A half wavelength (denoted as $\lambda/2$) fits lengthwise in the passenger compartment. A typical length of $\lambda/2=2.5$ m yields a frequency of $f=c/\lambda=68$ Hz when assuming a speed of sound of c is equal to 340 m/s. It can be seen from FIG. 1, that approximately at this frequency a maximum SPL can be observed at the rear listening locations. Therefore it can be concluded that superpositions of several standing waves in longitudinal and in lateral direction in the interior of the car (the listening room) are responsible for the inhomogeneous SPL distribution in the listening room.

Figure 3:
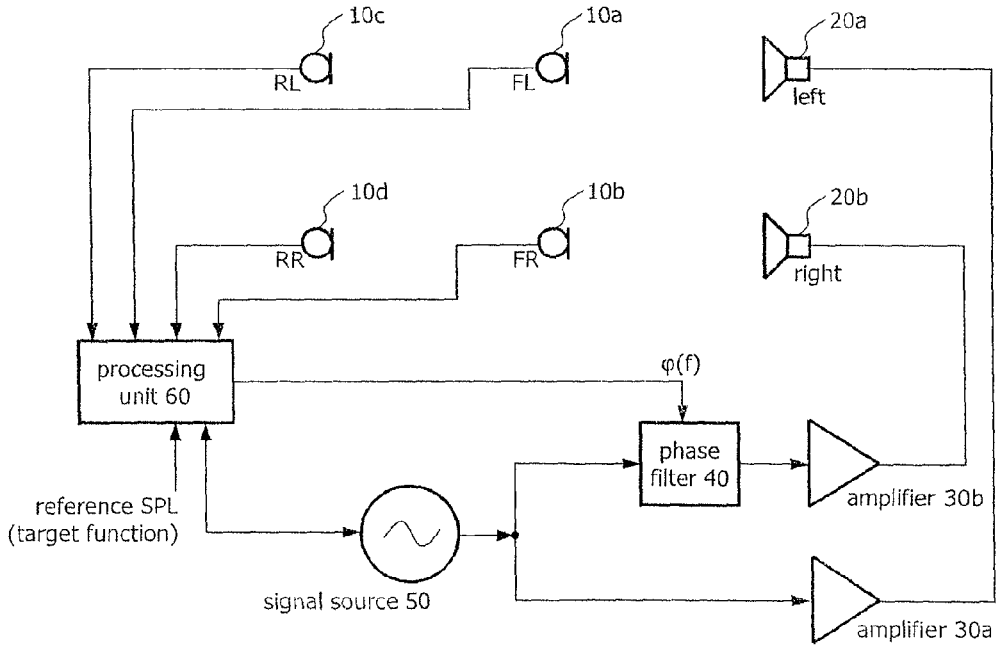
FIG. 3 illustrates an adaptive bass management system.

In order to achieve more similar—in the best case equal—SPL curves (magnitude over frequency) at a given set of listening locations within the listening room an automatic equalization of the sound pressure levels is suggested and explained below by way of examples. For the following discussion it is assumed that only two loudspeakers are arranged in a listening room (e.g., a passenger compartment of a car) where four different listening locations are of interest, namely a front left (FL), a front right (FR) a rear left (RL) and a rear right (RR) position. Of course the number of loudspeakers and listening locations is not limited. The method may be generalized to an arbitrary number of loudspeakers and listening locations. FIG. 3 illustrates such an audio system comprising two loudspeakers 20*a*, 20*b* and four listening positions (FL, FR, RL, RR) where a microphone 10*a*, 10*b*, 10*c*, 10*d* is provided at each listening location.

Both loudspeakers 20*a*, 20*b* are supplied with the same audio signal via supply channels (i.e., output channels of the signal source) comprising amplifiers 30*a*, 30*b*. Consequently both loudspeakers 20*a*, 20*b* contribute to the generation of the respective sound pressure level in each listening location. The audio signal is provided by a signal source 50 having an output channel for each loudspeaker to be connected. At least the output channel supplying the second one of the loudspeakers 20*a*, 20*b* is configured to apply a programmable phase shift $\phi(f)$ to the audio signal supplied to the second loudspeaker. The phase shift $\phi(f)$ is provided by a phase filter 40, for example, an FIR all-pass. A processing unit 60 calculates filter coefficients for the phase filter 40 from measured sound pressure levels $SPL_{FL}$, $SPL_{FR}$, $SPL_{RL}$, $SPL_{RR}$ received from the microphones 10*a*, 10*b*, 10*c*, and 10*d* respectively. For calculating the filter coefficients of the phase filter 40 a predefined target function may be considered, that is, the filter coefficients are adapted such that the frequency responses of the sound pressure levels $SPL_{FL}(f)$, $SPL_{FR}(f)$, $SPL_{RL}(f)$, $SPL_{RR}(f)$ at the listening locations approximate the predefined target function $SPL_{REF}(f)$. The functionality provided by the processing unit 60 is explained in the further discussion, that is, the processing unit is configured to perform at least one of the methods explained below.

Figure 4:
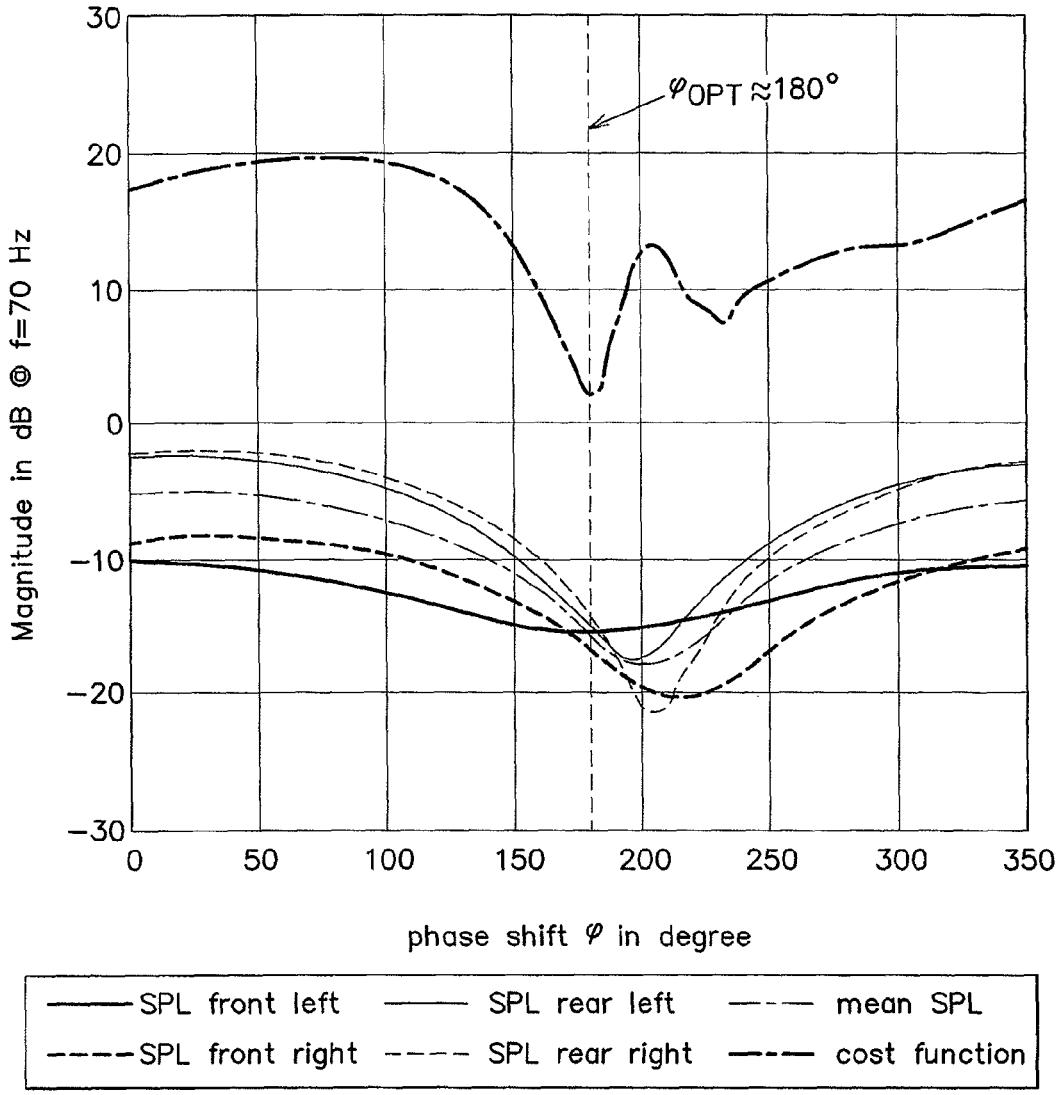
FIG. 4 illustrates the sound pressure level in decibel over phase shift which the audio signal supplied to one of the loudspeakers is subjected to a minimum distance between the sound pressure levels at the listening locations and a reference sound pressure level is found at the minimum of a cost function representing the distance.

The sound pressure level observed at listening locations of interest will change dependent on the phase shift applied to the audio signal that is fed to the second loudspeaker 20*b*, while the first loudspeaker 20*a* receives the same audio signal with no phase shift applied to it. Of course the audio signal supplied to the first loudspeaker 20*a* may also be phase shifted, but only the relative phase shifts between the considered audio signals is relevant. Consequently, the phase shift of the audio signal supplied to the first loudspeaker 20*a* may be arbitrarily set to zero for the following discussion. The dependency of sound pressure level SPL in decibel (dB) on phase shift $\phi$ in degree (°) at a given frequency f (in this example 70 Hz) is illustrated in FIG. 4 as well as the mean level of the four sound pressure levels measured at the four different listening locations.

A cost function $CF(\phi)$ is provided which represents the "distance" between the four sound pressure levels $SPL_{FL}(\phi)$, $SPL_{FR}(\phi)$, $SPL_{RL}(\phi)$, $SPL_{RR}(\phi)$ and a reference sound pressure level $SPL_{REF}(\phi)$ at a given frequency f. Such a cost function may be defined as:

$$CF(\phi)=|SPL_{FL}(\phi)-SPL_{REF}(\phi)|+|SPL_{FR}(\phi)-SPL_{REF}(\phi)|+|SPL_{RL}(\phi)-SPL_{REF}(\phi)|+|SPL_{RR}(\phi)-SPL_{REF}(\phi)|, \quad (1)$$

where the symbols $SPL_{FL}$, $SPL_{FR}$, $SPL_{RL}$, $SPL_{RR}$ denote the sound pressure levels at the front left, the front right, the rear left and the rear right positions respectively. The symbol $\phi$ in parentheses indicate that each sound pressure level is a function of the phase shift $\phi$. The distance between the actually measured sound pressure level and the reference sound pressure level $SPL_{REF}$ is a measure of quality of equalization, that is, the lower the distance, the better the actual sound pressure level approximates the reference sound pressure level. In the case that only one listening location is considered, the distance may be calculated as the absolute difference between measured sound pressure level and reference sound pressure level $SPL_{REF}$, which may theoretically become zero.

Equation 1 is an example for a cost function whose function value becomes smaller as the sound pressure levels $SPL_{FL}$, $SPL_{FR}$, $SPL_{RL}$, $SPL_{RR}$ approach the reference sound pressure level $SPL_{REF}$. At a given frequency, the phase shift $\phi$ that minimizes the cost function yields an "optimum" distribution of sound pressure level, that is, the sound pressure level measured at the four listening locations have approached the reference sound pressure level $SPL_{REF}$ as good as possible and thus the sound pressure levels at the four different listening locations are equalized resulting in an improved room acoustics. In the example of FIG. 4, the mean sound pressure level is used as reference $SPL_{REF}$ and the optimum phase shift that minimizes the cost function $CF(\phi)$ has been determined to be approximately 180° (indicated by the vertical line).

The cost function may be weighted with a frequency dependent factor that is inversely proportional to the mean sound pressure level. Accordingly, the value of the cost function is weighted less at high sound pressure levels. As a result an additional maximization of the sound pressure level can be achieved. Generally the cost function may depend on the sound pressure level, and/or the above-mentioned distance and/or a maximum sound pressure level. Furthermore, the reference $SPL_{REF}$ is not necessarily the mean sound pressure level as in Equation 1. The front left sound pressure level $SPL_{FL}$ may also be used as a reference sound pressure level $SPL_{REF}$ as well as a predefined target function. In the latter case the reference sound pressure level $SPL_{REF}$ is not dependent on the phase shift $\phi$, but only a function of frequency.

Figure 5:
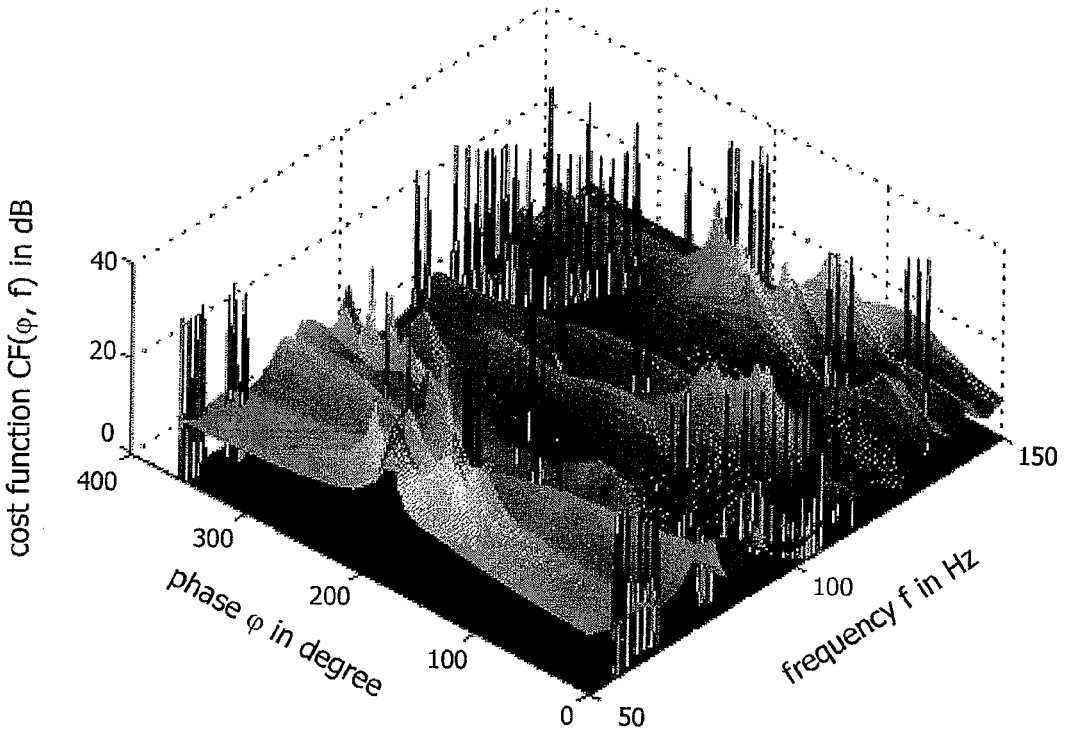
FIG. 5 is a plot of the cost function over phase at different frequencies.

In the above example, the optimal phase shift has been determined to be approximately 180° at a frequency of the audio signal of 70 Hz. Of course the optimal phase shift is different at different frequencies. Defining a reference sound pressure level $SPL_{REF}(\phi, f)$ for every frequency of interest allows for defining cost function $CF(\phi, f)$ being dependent on phase shift and frequency of the audio signal. An example of a cost function $CF(\phi, f)$ being a function of phase shift and frequency is illustrated as a 3D-plot in FIG. 5. The mean of the sound pressure level measured in the considered listening locations may be used as reference sound pressure level $SPL_{REF}(\phi, f)$. However, the sound pressure level measured at a certain listening location or any mean value of sound pressure levels measured in at least two listening locations may be used. Alternatively, a predefined target function (frequency response) of desired sound pressure levels may be used as reference sound pressure level $SPL_{REF}(f)$. Combinations of the above examples may also be useful.

Figure 6:
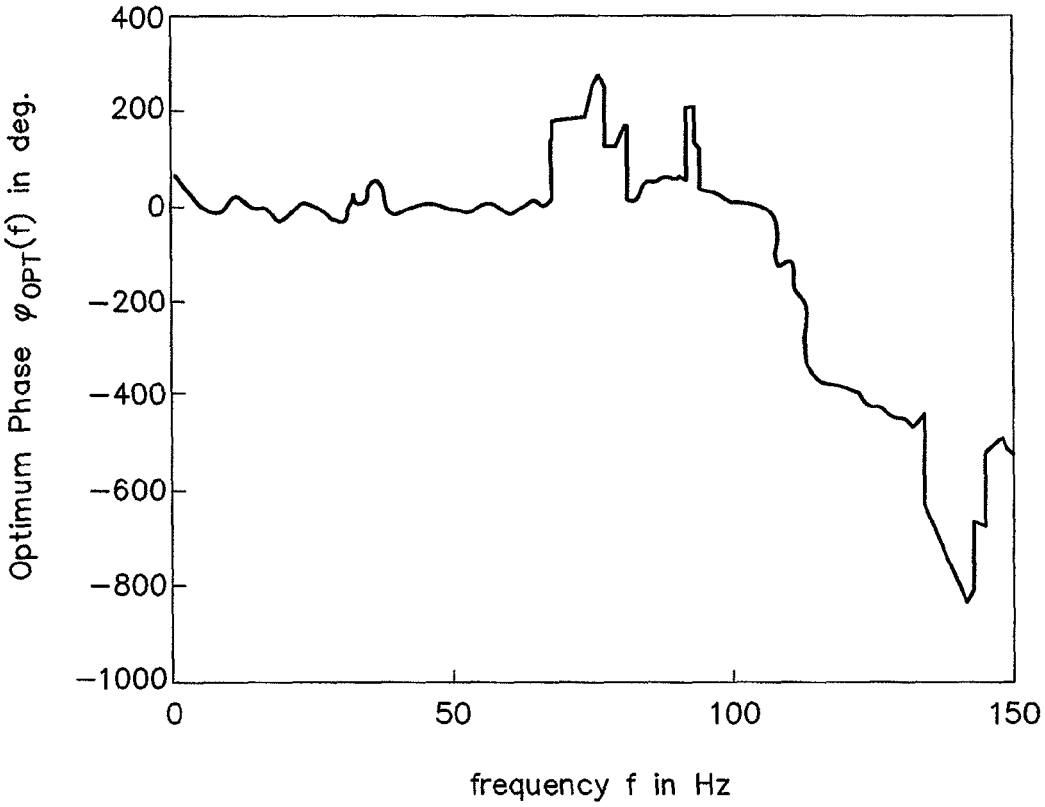
FIG. 6 illustrates a phase function of optimum phase shifts over frequency that minimizes the cost function at each frequency value.

For each frequency f of interest an optimum phase shift can be determined by searching the minimum of the respective cost function as explained above, thus obtaining a phase function of optimal phase shifts $\phi_{OPT}(f)$ as a function of frequency. An example of such a phase function $\phi_{OPT}(f)$ (derived from the cost function CF(ϕ, f) of FIG. 5) is illustrated in FIG. 6.

A technique for obtaining such a phase function $\phi_{OPT}(f)$ of optimal phase shifts for a sound system having a first and a second loudspeaker (cf. FIG. 3) shall now be summarized.

Supply an audio signal of a programmable frequency f to each loudspeaker. As explained above, the second loudspeaker has a delay element (e.g., phase filter) connected upstream thereto to apply a programmable phase-shift ϕ to the respective audio signal.

Measure the sound pressure level $SPL_{FL}(\phi, f)$, $SPL_{FR}(\phi, f)$, $SPL_{RL}(\phi, f)$, $SPL_{RR}(\phi, f)$ at each listening location for different phase shifts ϕ within a certain phase range (e.g., 0° to 360°) and for different frequencies within a certain frequency range (e.g., 0 Hz to 150 Hz).

Calculate the value of a cost function CF(ϕ, f) for each pair of phase shift ϕ and frequency f, where the cost function CF(ϕ, f) is dependent on the sound pressure level $SPL_{FL}(\phi, f)$, $SPL_{FR}(\phi, f)$, $SPL_{RL}(\phi, f)$, $SPL_{RR}(\phi, f)$, and optionally on a target function of desired sound pressure levels.

Search, for every frequency value f for which the cost function has been calculated, the optimal phase shift $\phi_{OPT}(f)$ which minimizes the cost function CF(ϕ, f), that is:

$$CF(\phi_{OPT}, f) = \min\{CF(\phi, f)\} \text{ for } \phi \in [0°, 360°], \tag{2}$$

thus obtaining a phase function $\phi_{OPT}(f)$ representing the optimal phase shift $\phi_{OPT}(f)$ as a function of frequency.

Of course, in practice the cost function is calculated for discrete frequencies $f = f_k \in \{f_0, f_1, \ldots, f_{K-1}\}$ and for discrete phase shifts $\phi = \phi_n \in \{\phi_0, \phi_1, \ldots, \phi_{N-1}\}$, where the frequencies may be a sequence of discrete frequencies with a fixed step-width Δf (e.g., Δf=1 Hz) as well as the phase shifts may be a sequence of discrete phase shifts with a fixed step-width Δϕ (e.g. Δϕ=1°). In this case the calculated values of the cost function CF(ϕ, f) may be arranged in a matrix CF[n, k] with lines and columns, where a line index k represents the frequency $f_k$ and the column index n the phase shift $\phi_n$. The phase function $\phi_{OPT}(f_k)$ can then be found by searching the minimum value for each line of the matrix. In mathematical terms:

$$\varphi_{OPT}(f_k) = \varphi_i \text{ for } CF[i, k] = \min\{CF[n, k]\}, \quad n \in \{0, \ldots N-1\}, k \in \{0, \ldots K-1\}. \tag{3}$$

For an optimum performance of the bass reproduction of the sound system the optimal phase shift $\phi_{OPT}(f)$, which is to be applied to the audio signal supplied to the second loudspeaker, is different for every frequency value f. A frequency dependent phase shift may be implemented by an all-pass filter (cf. phase filter 40 of FIG. 3) whose phase response has to be designed to match the phase function $\phi_{OPT}(f)$ of optimal phase shifts as good as possible. An all-pass with phase response equal to the phase function $\phi_{OPT}(f)$ that is obtained as explained above would equalize the bass reproduction in an optimum manner. A FIR all-pass filter may be appropriate for this purpose although some trade-offs have to be accepted.

In the following examples a 4096 tap FIR-filter is used for implementing the phase function $\phi_{OPT}(f)$. However, Infinite Impulse Response (IIR) filters—or so-called all-pass filter chains—may also be used instead, as well as analog filters, which may be implemented as operational amplifier circuits.

Referring to FIG. 6, one can see that the phase function $\phi_{OPT}(f)$ comprises many discontinuities resulting in very steep slopes $d\phi_{OPT}/df$. Such steep slopes $d\phi_{OPT}/df$ may be implemented by FIR filters with a sufficient precision when using extremely high filter orders, which is problematic in practice. Therefore, the slope of the phase function $\phi_{OPT}(f)$ is limited, for example, to ±10°. This means that the minimum search (cf. Equation 3) is performed with the constraint (side condition) that the phase must not differ by more than 10° per Hz from the optimum phase determined for the previous frequency value. In mathematical terms, the minimum search is performed according equation 3 with the constraint:

$$|\phi_{OPT}(f_k) - \phi_{OPT}(f_{k-1})| / |f_k - f_{k-1}| < 10°. \tag{4}$$

In other words, in the present example the function "min" (cf. equation 3) does not just mean "find the minimum" but "find the minimum for which equation 4 is valid". In practice the search interval where the minimum search is performed is restricted.

Figure 7:
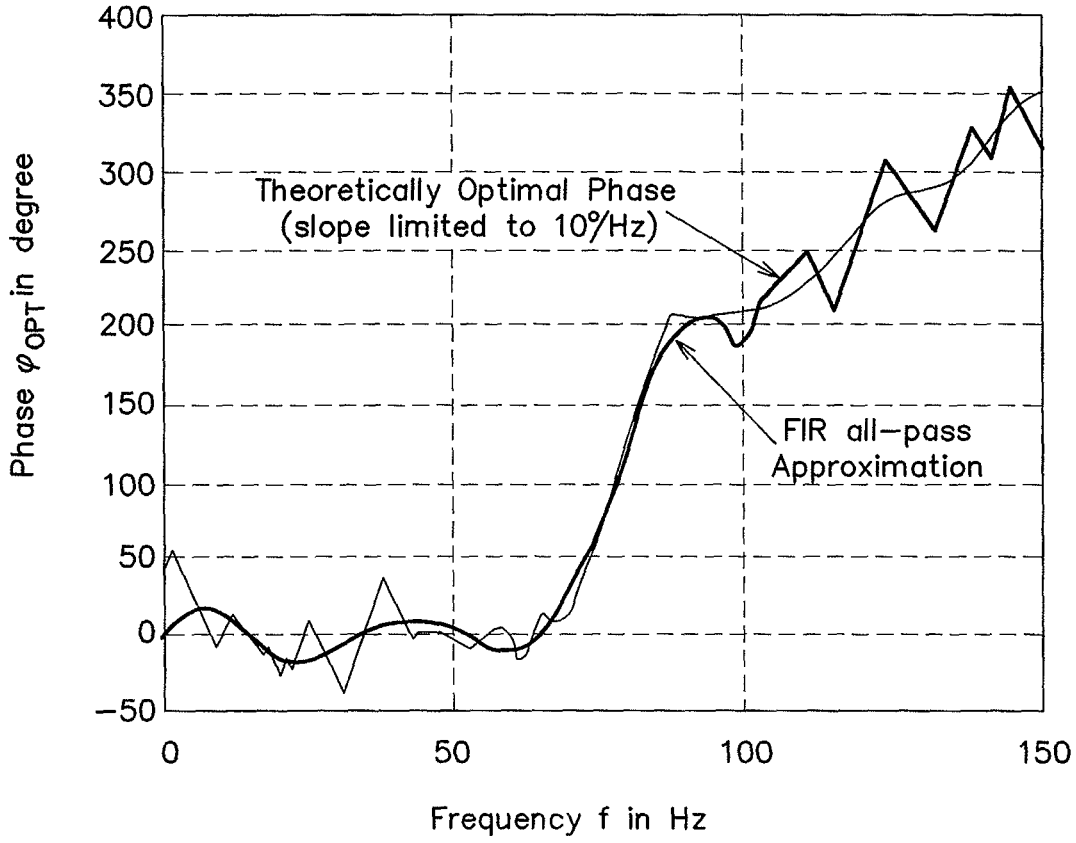
FIG. 7 illustrates the approximation of the phase function by the phase response of a 4096 tap FIR all-pass filter.
Figure 8A:
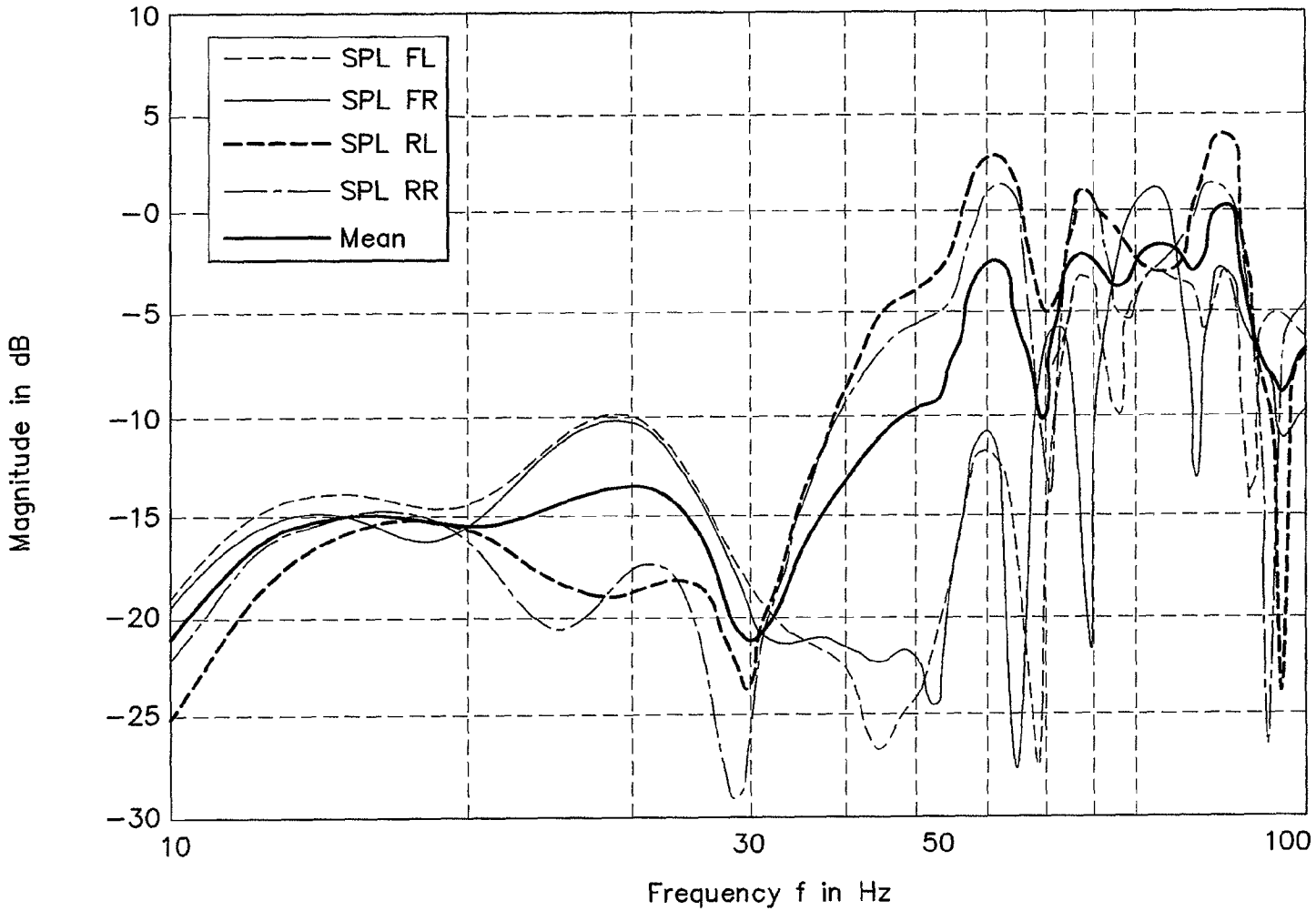
FIG. 8 illustrates the performance of the FIR all-pass filter of FIG. 7 and the effect on the sound pressure levels at the different listening locations.

FIG. 7 is a diagram illustrating a phase function $\phi_{OPT}(f)$ obtained according to Equations 3 and 4 where the slope of the phase has been limited to 10°/Hz. The phase response of a 4096 tap FIR filter that approximates the phase function $\phi_{OPT}(f)$ is also depicted in FIG. 7. The approximation of the phase is regarded as sufficient in practice. The performance of the FIR all-pass filter compared to the "ideal" phase shift $\phi_{OPT}(f)$ is illustrated in FIGS. 8*a* and 8*d*.

The examples described above comprise SPL measurements in at least two listening locations. However, for some applications it might be sufficient to determine the SPL curves only for one listening location. In this case a homogenous SPL distribution cannot be achieved, but with an appropriate cost function an optimization in view of another criterion may be achieved. For example, the achievable SPL output may be maximized and/or the frequency response, that is, the SPL curve over frequency, may be "designed" to approximately fit a given desired frequency response. Thereby the tonality of the listening room can be adjusted or "equalized", which is a common term used therefore in acoustics.

As described above, the sound pressure levels at each listening location may be actually measured at different frequencies and for various phase shifts. However, this measurement alternatively may be fully or partially replaced by a model calculation to determine the sought SPL curves by simulation. For calculating sound pressure level at a defined listening location knowledge about the transfer characteristic from each loudspeaker (cf. loudspeakers 20*a*, 20*b* in FIG. 3) to each listening location (cf. locations FL, FR, RL, RR in FIG. 3) is required. In the case of the system of FIG. 3 (four listening locations and two loudspeakers) eight transfer characteristics, for example, frequency or impulse responses, have to be determined.

Consequently, before starting calculations the overall transfer characteristic from the loudspeakers to the listening locations have to be identified, for example, estimated from measurements. For example, the impulse responses may be estimated from sound pressure level measurements when supplying a broad band signal consecutively to each loudspeaker. In addition, adaptive filters may be used for estimation. Other known methods for parametric and nonparametric model estimation may also be employed.

After the necessary transfer characteristics have been determined, the desired SPL curves, for example the matrix visualized in FIG. 4, may be calculated based on a model, that is, based on the previously determined transfer characteristics. Thereby one transfer characteristic, for example an impulse response, is associated with a certain pair of loudspeaker and listening location. The sound pressure level is calculated by simulation at each listening location assuming, for the calculation, that a simulated audio signal of a programmable frequency is supplied to each loudspeaker, where the audio signal supplied to the second loudspeaker is phase-shifted by a programmable phase shift relative to the simulated audio signal supplied to the first loudspeaker. Thereby, the phase shifts of the audio signals supplied to the other loudspeakers are initially zero or constant. In this context the term "assuming" has to be understood considering the mathematical context, that is, the frequency, amplitude and phase of the audio signal are used as input parameters in the model calculation. In other words, the above described measurements of sound pressure levels at different frequencies and phase shifts may be simulated.

For each listening location this model based calculation may be split up in the following steps where the second loudspeaker has a phase-shifting element with the programmable phase shift connected upstream thereto:

Calculate amplitude and phase of the sound pressure level generated by the first and the second loudspeaker, alternatively by all loudspeakers, at the considered listening location when supplied with an audio signal of a frequency f using the corresponding transfer characteristics (e.g., impulse responses) for the calculation, whereby the second loudspeaker is assumed to be supplied with an audio signal phase shifted by an amount $\phi$ with respect to the audio signal supplied to the first loudspeaker;

Superpose with proper phase relation the above calculated sound pressure levels thus obtaining a total sound pressure level at the considered listening location as a function of frequency f and phase shift $\phi$.

Once the SPL curves for the relevant phase and frequency values have been calculated, the optimal phase shift for each considered loudspeaker may be determined as described above. The effect of the phase shift may be subsequently determined for each further loudspeaker.

In the examples presented above, a system comprising only two loudspeakers and four listening locations of interest has been assumed. In such a system only one optimal phase function has to be determined and the corresponding FIR filter implemented in the channel supplying one of the loudspeakers (referred to as second loudspeaker in the above examples). In a system with more than two loudspeakers, an additional phase function of optimal phase shifts $\phi_{OPTi}$ (index i denotes the respective loudspeaker) has to be determined and a corresponding FIR all-pass filter has to be implemented in the channel supplying each additional loudspeaker. If more than four listening locations are of interest all of them have to be considered in the respective cost function. A more general approach may be summarized as follows:

(a) perform the following steps for each of the L loudspeakers i=2, 3, . . . , L;

(b) determine the transfer characteristic of each combination of the loudspeaker and listening locations;

(c) simulate, using the transfer characteristics, for different frequencies and different phase shifts of the audio signal related to the considered loudspeaker, the sound pressure level at each listening location, where the phase shifts of the audio signals supplied to the other loudspeakers are initially zero or constant;

(d) calculate, for pairs of phase shifts and frequencies, a cost function dependent on the calculated sound pressure levels; and (e) search a frequency dependent optimal phase shift that yields an extremum (e.g., optimum) of the cost function, thus obtaining a phase function representing the optimal phase shift as a function of frequency; and (f) set coefficients of a phase filter upstream to the considered loudspeaker to provide a phase response that at least approximately matches the phase function of optimal phase shifts.

As explained later in more detail, the above-described method can also be employed to determine an optimal offset phase function $\Delta\phi_{OPT}(f)$ for correcting an initial phase function $\Delta\phi_{OPT}(f)$ previously imposed to the signal path of a loudspeaker.

For an adaptive bass management the estimated transfer characteristics have to be updated in order to allow for accommodating to slowly varying transfer characteristics during operation of the audio system. At the end of the production process, the listening room (e.g., the interior of a car) may be equipped with an audio system comprising a bass management system and the above-mentioned transfer characteristics may then be identified using one of the methods discussed above. These transfer characteristics are stored in a memory of the audio system and used as initial transfer characteristics for the subsequent adaptation process during normal operation of the audio system.

In adaptive bass management variations of the transfer characteristics from the loudspeakers 20*a*, 20*b* to the listening locations FL, FR, RL, RR are considered (cf. FIG. 3). This is done by regularly updating the estimated impulse responses (respectively transfer functions) during operation starting from a-priori known initial transfer characteristics that may be determined after the installation of the audio system.

In each adaptation step updated transfer characteristics from the loudspeakers 20*a*, 20*b* to each microphone 10*a*, 10*b*, 10*c*, 10*d* are calculated considering the filter 40 (cf. FIG. 3) providing a certain phase response $\phi_k(f)$. The filter is arranged in a signal path (output channel) upstream to a given loudspeaker (e.g., loudspeaker 20*b*). The index k represents the number of the adaptation step. The changes of the room transfer functions between the loudspeakers and the microphones happen slowly, hence we can assume the impulse responses as constant, for a certain time interval. Within this time interval, an optimal offset phase function $\Delta\phi_{OPT}(f)$ may be calculated for each considered frequency employing the purely model based method, as described above. After the calculation of the optimal offset phase function $\Delta\phi_{OPT}(f)$ an updated phase function $\phi_{k+1}(f)$ (ideal phase response of the phase filter 40) may be calculated:

$$\phi_{k+1}(f)=\phi_k(f)+\Delta\phi_{OPT}(f).$$

A new set of (approximated) filter coefficients may then be calculated from the phase function as already described with reference to the methods discussed before. The adaptive bass management system works properly if the bandwidth of the reproduced audio signal during operation has enough signal power in the considered bass frequency range (e.g., 20 Hz to 150 Hz) to allow for a proper estimation of the required updated transfer characteristics.

The procedure may be repeated permanently during operation of the audio system. The bass management system is then capable to adapt to varying environmental conditions that lead to changes in the transfer characteristics from the loudspeakers to the listening locations.

As explained above, transfer characteristics from each single loudspeaker to each listening location are required for a proper model based calculation of the optimal phase function $\phi_{OPT}(f)$ or the optimal offset phase function $\Delta\phi_{OPT}(f)$, respectively. During normal operation of the audio system, an acoustic sound signal (e.g., music signal) is simultaneously radiated from all loudspeakers which makes it difficult to find an updated transfer characteristics for each single pair of loudspeaker and listening location. However, starting from an a-priori known transfer characteristic (which once has been previously determined) certain mathematical algorithms may be used for calculating the desired updated transfer characteristics from measurements of overall transfer functions describing the transfer characteristics from all loudspeakers to each considered listening location. Such algorithms may, for example, be multiple-error least-mean-square (MELMS) algorithms.

When reproducing stereo sound, or surround sound (multichannel audio) like DTS 5.1 discrete, Dolby digital 5.1, etc., the audio channels may be monitored, and, if a time interval is detected where only one loudspeaker is active, the corresponding transfer characteristics for this single loudspeaker are determined. The occurrence of such time intervals depends on the sound (music) signal actually reproduced. In this way the transfer characteristics may be estimated separately for each loudspeaker instead of overall transfer characteristics. When estimating a transfer characteristic from one single loudspeaker to one certain listening location the other loudspeakers do not necessarily have to be silent, but the signal levels (volume) of the other loudspeakers have to be sufficiently silent or the signals radiated from the other loudspeakers have to be uncorrelated to the signal radiated from the considered loudspeaker. In the latter case the signals of the other loudspeakers may be treated as noise. However, an increased noise level due to the other loudspeaker signals (being uncorrelated with the considered loudspeaker signal) has a negative impact on the quality of estimation of the sought transfer characteristics. The best performance of the estimation is achieved if only the considered loudspeaker is active during measurements used for estimation of the sought transfer characteristics.

Once having estimated updated transfer characteristics for each pair of loudspeaker and listening location, the adaptation method may continue as described above and discussed below in more detail.

One example of the adaptive technique for setting optimal phase shift values $\phi_{k+1}(f)$ by adding optimal phase shift offset $\Delta\phi_{OPT}(f)$ to the actual phase shift values $\phi_k(f)$ in the signal path of a loudspeaker during operation of the audio system is now summarized on the basis of the exemplary audio system of FIG. 3 having four listening locations FL, FR, RL, RR and two loudspeakers 20*a*, 20*b:*

(a) reproduce an audio signal via at least two signal paths each supplying a loudspeaker 20*a*, 20*b* generating an acoustic sound signal; the audio signal comprises signal components that cover at least the bass range, for example the frequency range from 20 Hz to 150 Hz; one signal path (e.g., the one supplying loudspeaker 20*b*) comprises a phase shifter 40 that provides a phase shift $\phi_k(f)$ to the signal being supplied to the respective loudspeaker 20*b*, whereas the phase shift imposed to the other signal path is zero or constant; initial transfer characteristics of each pair of loudspeaker and listening location being a-priori known from separate measurements;

(b) receive the resulting sound signal, at each listening location FL, FR, RL, RR, and provide electrical signals representing the sound signal at the respective listening location;

(c) estimate updated transfer characteristics (e.g., impulse response or frequency response) for each pair of loudspeaker (20*a*, 20*b*) and listening location (FL, FR, RL, RR) from the electrical signals and the audio signal;

(d) calculate the frequency dependent phase shift offset $\Delta\phi_{OPT}(f)$ based on a model;

(e) update the phase shift $\phi_k(f)$ to the audio signal supplying the second loudspeaker 20*b* according to the equation $\phi_{k+1}(f)=\phi_k(f)+\Delta\phi_{OPT}(f)$.

(f) perform the subsequent adaptation step by repeating the above steps with an updated phase shift $\phi_{k+1}(f)$.

If more than two loudspeakers are used the steps (a) to (f) of the above method may be repeated for all loudspeakers except the first one.

The SPL curves depicted in the diagrams of FIG. 8 have been obtained by simulation to demonstrate the effectiveness of the method described above. FIG. 8*a* illustrates the sound pressure levels $SPL_{FL}$, $SPL_{FR}$, $SPL_{RL}$, $SPL_{RR}$ measured at the four listening locations before equalization, that is, without phase modifications applied to the audio signal. The thick black solid line represents the mean of the four SPL curves. The mean SPL has also been used as reference sound pressure level $SPL_{REF}$ for equalization. As in FIG. 1 a large discrepancy between the SPL curves is observable, especially in the frequency range from 40 to 90 Hz.

Figure 8B:
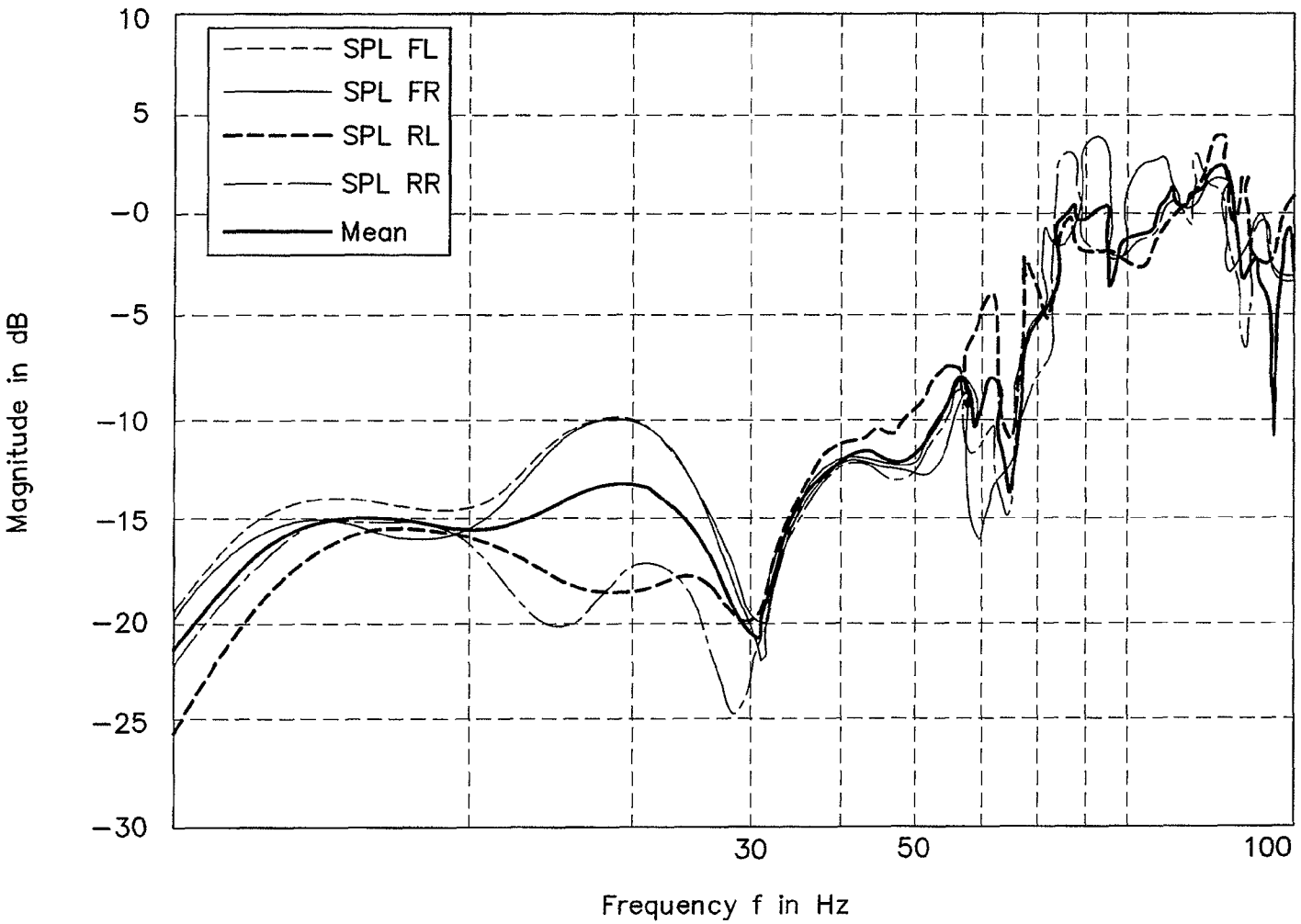

FIG. 8*b* illustrates the sound pressure levels $SPL_{FL}$, $SPL_{FR}$, $SPL_{RL}$, $SPL_{RR}$ measured at the four listening locations after equalization using the optimal phase function $\phi_{OPT}(f)$ of FIG. 6 (without limiting the slope $\phi_{OPT}/df$). One can see that the SPL curves are much more alike (i.e., equalized) and deviate by small amounts from the mean sound pressure level (thick black solid line).

Figure 8C:
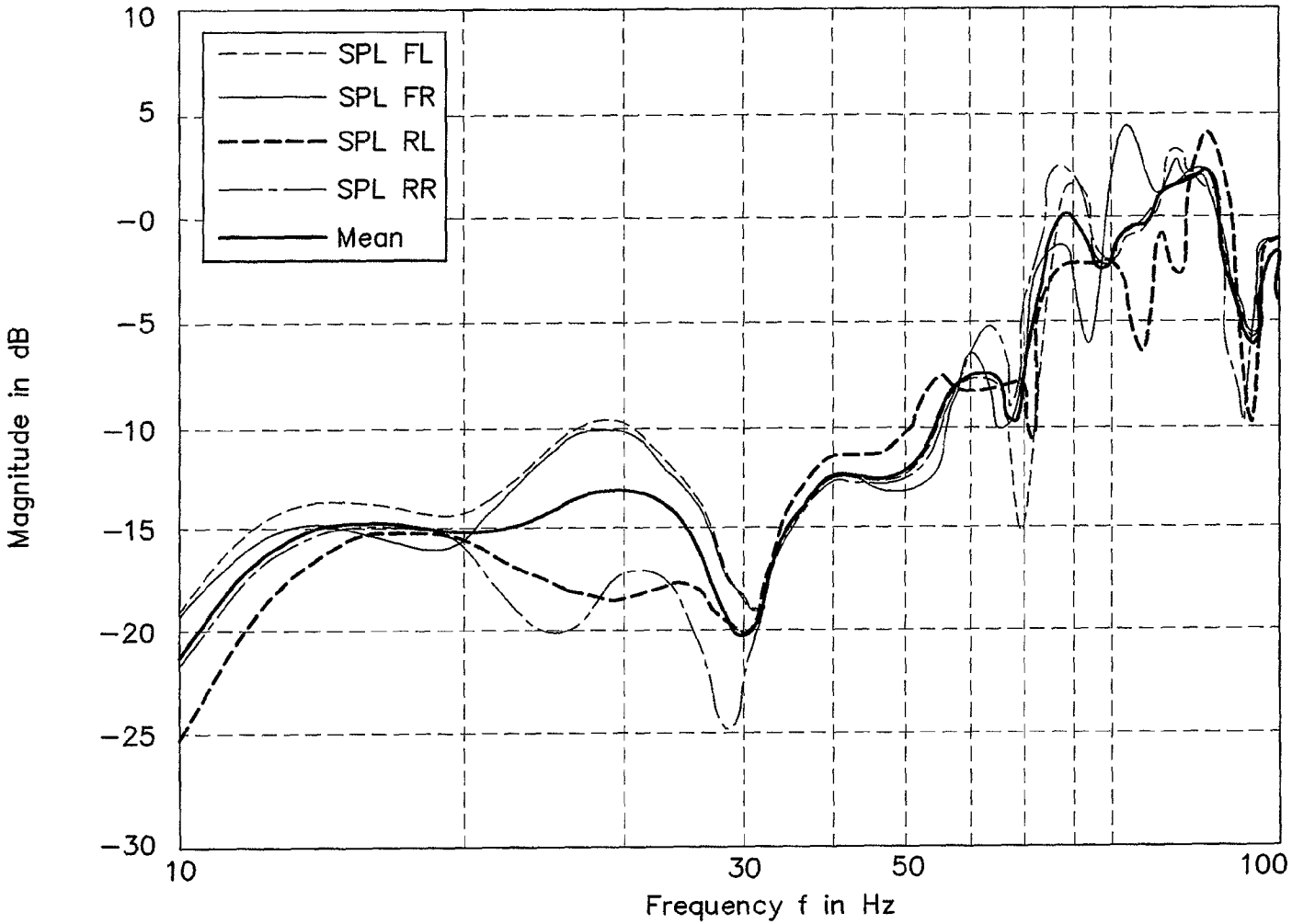
Figure 8D:
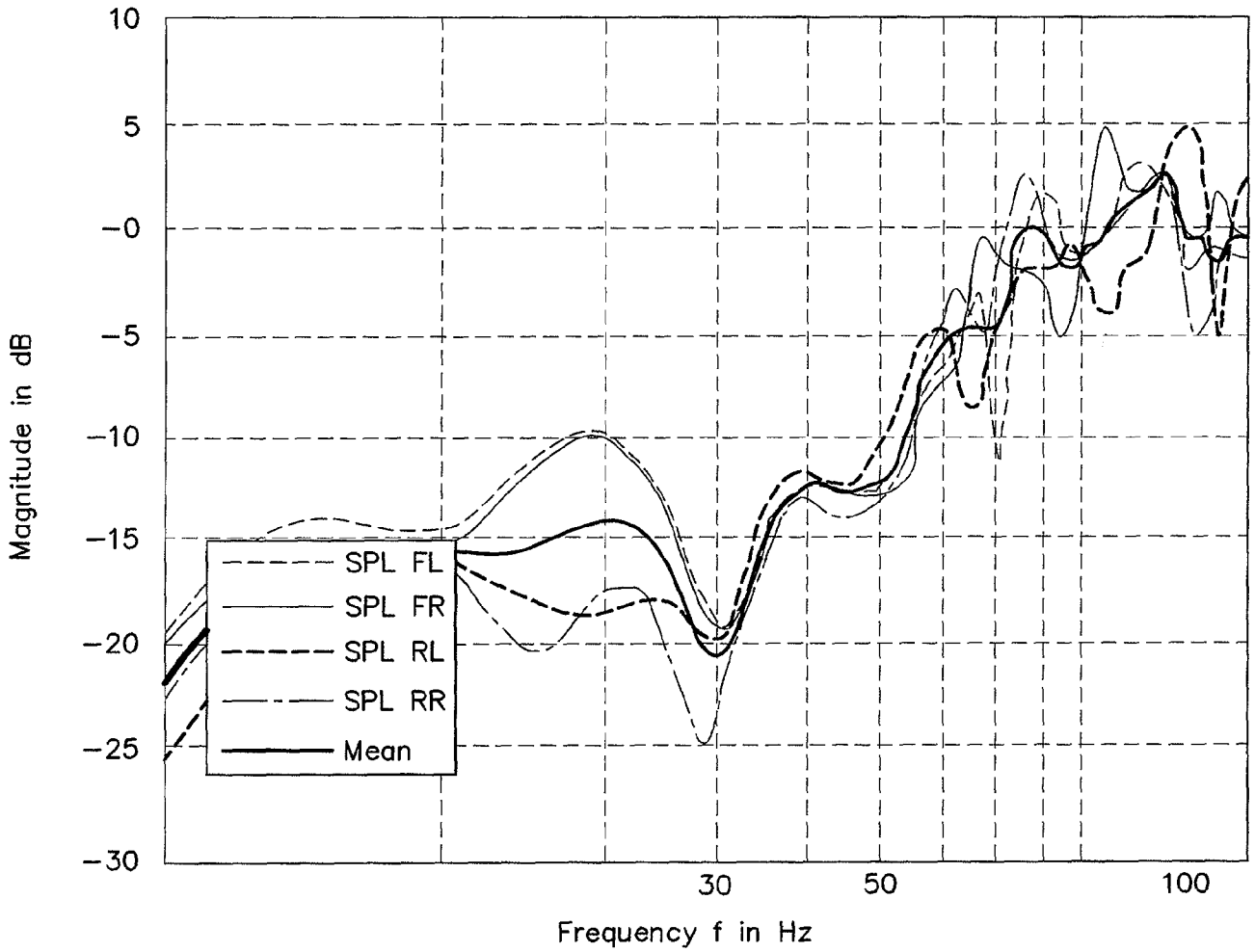

FIG. 8*c* illustrates the sound pressure levels $SPL_{FL}$, $SPL_{FR}$, $SPL_{RL}$, $SPL_{RR}$ measured at the four listening locations after equalization using the slope-limited phase function of FIG. 7. It is noteworthy that the equalization performs almost as good as the equalization using the phase function of FIG. 6. As a result the limitation of the phase change to approximately 10°/Hz is regarded as a useful measure that facilitates the design of a FIR filter for approximating the phase function $\phi_{OPT}(f)$.

FIG. 8*d* illustrates the sound pressure levels $SPL_{FL}$, $SPL_{FR}$, $SPL_{RL}$, $SPL_{RR}$ measured at the four listening locations after equalization using a 4096-tap FIR all-pass filter for providing the necessary phase shift to the audio signal supplied to the second loudspeaker. The phase response of the FIR filter is depicted in the diagram of FIG. 7. The result is also satisfactory. The large discrepancies occurring in the unequalized system are avoided and acoustics of the room is substantially improved.

In the examples presented above, a system comprising only two loudspeakers and four listening locations of interest has been assumed. In such a system only one optimal phase function has to be determined and the corresponding FIR filter implemented in the output channel (i.e., signal path) supplying one of the loudspeakers (referred to as second loudspeaker in the above examples). In a system with more than two loudspeakers an additional phase function has to be determined and a corresponding FIR all-pass filter has to be implemented in the output channel supplying each additional loudspeaker. If more than four listening locations are of interest all of them have to be considered in the respective cost function. The general procedure of adaptive bass management may be summarized as follows:

(a) assign a number i=1, 2, . . . , L to each one of L loudspeakers and the corresponding output channels.

(b) Supply a broad band audio signal (e.g., a music signal) via L signal paths (output channels) to each loudspeaker 1, 2, . . . , L. Loudspeakers 1 to L receive the respective audio signal from a signal source which has one output channel per loudspeaker connected thereto. At least the channels supplying loudspeakers 2 to L modify the phase $\phi_{2,k}(f)$, $\phi_{3,k}(f)$, . . . , $\phi_{L,k}(f)$ of the respective audio signal according to predetermined phase functions (phase $\phi_1(f)$ may be zero or constant); an acoustic sound signal is thus radiated by the loudspeakers 1 to L during the adaptation method; initial transfer characteristics of each pair of loudspeaker and listening location being a-priori known from separate measurements.

(c) Receive the resulting sound signal, at each listening location FL, FR, RL, RR, and provide electrical signals representing the sound signal at the respective listening location.

(d) Estimate updated transfer characteristics for each pair of the loudspeaker (1, 2, . . . , L) and listening location (FL, FR, RL, RR) from the respective electrical signals, the audio signal and the initial transfer characteristics.

(e) Calculate, for loudspeaker number i=2, the frequency dependent optimal phase shift offset $\Delta\phi_{OPT2}(f)$ based on a model using the updated transfer characteristics as explained above.

(f) Update the phase shifter that modifies the phase upstream of loudspeaker number i=2, in order to (at least approximately) provide an updated phase shift $\phi_{2,k+1}(f)=\phi_{2,k}(f)+\Delta\phi_{OPT2}(f)$.

(g) Repeat steps (a) and (f) for loudspeakers i=3, . . . , L, thus obtaining updated phase shifts $\phi_{3,k+1}(f)$, . . . , $\phi_{L,k+1}(f)$.

(h) Continue the adaptation process by repeating the above steps (c) to (g), thus subsequently obtaining updated phase shifts $\phi_{i,k+2}(f)$, $\phi_{i,k+3}(f)$, . . . for all loudspeakers i=2 to L.

From FIGS. 8*b-d* it can be seen that a substantial difference in sound pressure levels was not be equalized in a frequency range from about 20 to 30 Hz. This is due to the fact that only one loudspeaker (e.g., the subwoofer) of the sound system under test is able to reproduce sound with frequencies below 30 Hz. Consequently, in this frequency range the other loudspeakers were unable to radiate sound and therefore can not be used for equalizing. If a second subwoofer would be employed then this gap in the SPL curves may be "closed", too.

After equalizing all the loudspeakers as explained above an additional frequency-dependent gain may be applied to all channels in order to achieve a desired magnitude response of the sound pressure levels at the listening locations of interest. This frequency-dependent gain is the same for all channels.

The above-described examples relate to techniques for equalizing sound pressure levels in at least two listening locations. Thereby a "balancing" of sound pressure is achieved. However, the method can be also usefully employed when the "balancing" is the not goal of optimization, but rather a maximization of the sound pressure at the listening locations and/or the adjusting of actual sound pressure curves (SPL over frequency) to match a "target function". In this case the cost function has to be chosen accordingly. If only the maximization of sound pressure or the adjusting of the SPL curve(s) in order to match a target function is to be achieved, this can also be done for only one listening location. In contrast, at least two listening locations have to be considered when a balancing is desired.

For a maximization of sound pressure level the cost function is dependent from the sound pressure level at the considered listening location. In this case the cost function has to be maximized in order to maximize the sound pressure level at the considered listening location(s). Thus the SPL output of an audio system may be improved in the bass frequency range without increasing the electrical power output of the respective audio amplifiers.

As disclosed above, a first example of a technique for adapting sound pressure levels in at least one listening location comprises generating the sound pressure using first and a second loudspeakers, each loudspeaker having a supply channel arranged upstream thereto, where at least the supply channel of the second loudspeaker modifies the phase of an audio signal transmitted therethrough according to a phase function. The method further comprises: supplying an audio signal to the supply channels and thus generating an acoustic sound signal; measuring the acoustic sound signal at each listening location and providing corresponding signals (e.g., electrical) representing the measured acoustic sound signal; estimating updated transfer characteristics for each pair of loudspeaker and listening location; calculating an optimum offset phase function based on a mathematical model using the estimated transfer characteristics; updating the phase function by superposing the optimal offset phase function thereto.

According to another example, the calculation of an optimum offset phase function may comprise: simulating, for different frequencies and phase shifts in the supply channel of the second loudspeaker, sound pressure levels at each listening location, where the phase shifts of the audio signals supplied to the other loudspeakers are initially zero or constant; evaluating, for the different frequencies and phase shifts, a cost function dependent on the sound pressure level; and searching a frequency dependent optimal phase shift that yields an extremum of the cost function, thus obtaining a phase function representing the optimal phase shift as a function of frequency.

In a further example of the invention in the above methods sound pressure levels in at least two listening locations are considered.

In another example of the invention the cost function is dependent on the calculated sound pressure levels and a previously defined target function. In this case the actual sound pressure levels are equalized to the target function.

Another example of the invention relates to a system for adapting sound pressure levels in at least one listening location. The system comprises: a first and a second loudspeaker for generating an acoustic sound signal from an audio signal; a supply channel arranged upstream to each loudspeaker receiving the audio signal, at least the supply channel linked to the second loudspeaker comprising means for modifying the phase of the audio signal transmitted therethrough according to a phase function; sensors for measuring the acoustic sound signal at each listening location and providing corresponding electrical signals representing the measured acoustic sound signal; a processing unit that estimates updated transfer characteristics for each pair of loudspeaker and listening location; calculates based on a mathematical model using the estimated transfer characteristics; and updates the phase function by superposing the optimal offset phase function thereto.

Although various examples to realize the invention have been disclosed, it will be apparent to those skilled in the art that various changes and modifications can be made which will achieve some of the advantages of the invention without departing from the spirit and scope of the invention. It will be obvious to those reasonably skilled in the art that other components performing the same functions may be suitably substituted. Such modifications to the inventive concept are intended to be covered by the appended claims. Furthermore the scope of the invention is not limited to automotive applications but may also be applied in any other environment, for example in consumer applications like home cinema or the like and also in cinema and concert halls or the like.

What is claimed is:

1. A method for adapting sound pressure levels in at least one listening location, the sound pressure being generated by first and second loudspeakers, each loudspeaker having a supply channel arranged upstream thereto, where at least the supply channel of the second loudspeaker modifies the phase of an audio signal transmitted therethrough according to a phase function, the method comprising:

supplying an audio signal to the supply channels and generating an acoustic sound signal;

measuring the acoustic sound signal at the listening locations and for each listening location providing corresponding electrical signals representing the measured acoustic sound signal;

estimating updated transfer characteristics for each pair of loudspeaker and listening location based upon the measured acoustic sound signals;

calculating an optimum offset phase value based on a mathematical model using the estimated transfer characteristics, wherein the optimum offset phase function is achieved when a resulting frequency response of the sound pressure levels at the listening location matches a predetermined target function; and updating the phase function by superposing the optimal offset phase function thereto.

2. The method of claim 1, where the calculating step comprises:

simulating, for different frequencies and phase shifts in the supply channel of the second loudspeaker, sound pressure levels at each of the listening locations, where the phase shifts of the audio signals supplied to the other loudspeakers are zero or constant;

evaluating, for the different frequencies and phase shifts, a cost function dependent on the sound pressure level; and searching a frequency dependent optimal phase shift that yields an extremum of the cost function, thus obtaining a phase function representing the optimal phase shift as a function of frequency.

3. The method of claim 2, where the searching step comprises:

evaluating the cost function for pairs of phase shift and frequency; and searching, for each frequency for which the cost function has been evaluated, an optimal phase shift that yields an extremum of the cost function.

4. The method of claim 2, where the cost function is dependent on the sound pressure level, and, in the searching step, an optimal phase shift is determined that maximizes the cost function yielding a maximal sound pressure level.

5. The method of claim 2, where the cost function is dependent on the sound pressure level and a reference sound pressure level, and in the searching step, an optimal phase shift is determined using the cost function, the cost function representing the distance between the sound pressure level at the at least one listening location and the reference sound pressure level.

6. The method of claim 5, where the reference sound pressure level is a predefined target function of a desired sound pressure level over frequency.

7. The method of claim 5, where the sound pressure levels are calculated for at least two listening locations, and the reference sound pressure level is either the sound pressure level calculated for the first listening location or the mean value of the sound pressure levels calculated for at least two listening locations.

8. The method of claim 7, where the cost function is calculated as the sum of the absolute differences of each calculated sound pressure level and the reference sound pressure level for each phase value and each frequency.

9. The method of claim 2, where the cost function is weighted with a frequency dependent factor that is inversely proportional to the mean sound pressure level.

10. The method of claim 1, comprising a third loudspeaker having a third supply channel arranged upstream thereto which comprises a phase shifter that modifies the phase of the audio signal transmitted therethrough according to a third phase function, the method further comprising:

calculating a further optimal offset phase function based on a mathematical model using the estimated transfer characteristics;

updating the further phase function by superposing the further optimal offset phase function thereto.

11. The method of claim 10, where the phase shifter comprises a phase filter having filter coefficients defining a phase response.

12. The method of claim 11 where the phase filter is a finite impulse response filter, the step of updating the phase function further comprises:

calculating updated filter coefficient values such that the resulting phase response at least approximately matches the optimal phase function; and setting the filter coefficients to the updated filter coefficient values.

13. A system for adapting sound pressure levels in at least one listening location, comprising:

a first loudspeaker and a second loudspeaker each for generating an acoustic sound signal from an audio signal;

a supply channel arranged upstream to each loudspeaker receiving the audio signal, the supply channel linked to the second loudspeaker comprising an all pass filter that modifies the phase of the audio signal transmitted therethrough according to a phase function;

a sensor that measures the acoustic sound signal at a plurality of listening locations and provides corresponding electrical signals representing the measured acoustic sound signal for each of the listening locations; and a processor that estimates updated transfer characteristics for each pair of loudspeaker and listening locations and provides estimated transfer characteristics, calculates an optimum phase offset value based on a mathematical model using the estimated transfer characteristics, wherein the optimum offset phase function is achieved when a resulting frequency response of the sound pressure levels at the listening location matches a predetermined target function, and updates the phase function by superposing the optimal offset phase function thereto.

14. The system of claim 13, where the processor also (i) simulates sound pressure levels at each listening location for different frequencies and phase shifts in the supply channel of the second loudspeaker, where the phase shifts of the audio signals supplied to the other loudspeakers are initially zero or constant; (ii) evaluates a cost function dependent on the sound pressure level for the different frequencies and phase shifts; and (iii) determines a frequency dependent optimal phase shift that yields an extremum of the cost function, thus obtaining a phase function representing the optimal phase shift as a function of frequency.

* * * * *